United States Patent [19]

McLaren

[11] Patent Number: 4,667,836

[45] Date of Patent: May 26, 1987

[54] TAMPER-RESISTANT AND CHILD-RESISTANT CONTAINER AND CLOSURE ASSEMBLY

[75] Inventor: Kevin W. McLaren, Erith, England

[73] Assignee: Johnsen & Jorgensen Plastics Ltd., London, England

[21] Appl. No.: 883,968

[22] Filed: Jul. 10, 1986

[30] Foreign Application Priority Data

Jul. 19, 1985 [GB] United Kingdom ..... 8518280

[51] Int. Cl.[4] ..... B65D 55/02

[52] U.S. Cl. ..... 215/216; 215/258

[58] Field of Search ..... 215/216, 258, 253

[56] References Cited

U.S. PATENT DOCUMENTS 4,134,513 1/1979 Mumford ..... 215/216

4,452,363 6/1984 Davis ..... 215/216

*Primary Examiner*—George T. Hall

*Attorney, Agent, or Firm*—Wood, Dalton, Phillips, Mason & Rowe

[57] ABSTRACT

A tamper resistant and child resistant container and closure assembly comprising a container body with a substantially cylindrical neck including an externally screw threaded portion near to the top and below the screw thread a plurality of cams each with an inclined surface terminating in a sharp shoulder, a closure with a body which tapers internally outwardly from an internally screw threaded part near to the top of the closure and which has a corresponding number of depending webs below the screw thread for engagement with the cams on the container neck in the manner of a ratchet and pawl mechanism and a tamper-resistant band provided below the closure body and connected thereto by frangible means, the band being provided with internal webs vertically below the webs on the closure body also for engagement with the cams so that when the closure is unscrewed after disengagement of the body webs from the cams, the band is prevented from turning by the engagement of the band webs with the cams and the frangible means break.

7 Claims, 9 Drawing Figures

TAMPER-RESISTANT AND CHILD-RESISTANT CONTAINER AND CLOSURE ASSEMBLY

This invention is concerned with the provision of a tamper-resistant and child-resistant container and closure assembly and with the provision of a novel form of closure.

According to a feature of the present invention we provide a tamper-resistant and child-resistant container and closure assembly comprising a container body with a substantially cylindrical neck including an externally screw threaded portion near to the top and below the screw thread a plurality of cams each with an inclined surface terminating in a sharp shoulder, a closure with a body which tapers internally outwardly from an internally screw threaded part near to the top of the closure and which has a corresponding number of depending webs below the screw thread for engagement with the cams on the container neck in the manner of a ratchet and pawl mechanism and a tamper-resistant band provided below the closure body and connected thereto by frangible means the band being provided with internal webs vertically below the webs on the closure body also for engagement with the cams so that when the closure is unscrewed after disengagement of the body webs from the cams, the band is prevented from turning by the engagement of the band webs with the cams and the means break.

It is an important feature of the invention that the closure body has internal webs which we call the closure webs and that the band also has internal webs which we call the band webs.

The cams on the container neck are deep enough in a vertical direction to engage with both sets of webs. The closure has a top and a depending skirt which tapers outwardly while the neck of the container is substantially vertical. This arrangement provides a gap between the skirt and the neck which accomodates both sets of webs and which enables the closure webs to be disengaged from the cams by squeezing the closure at squeeze positions preferably displaced by about 90° from the closure webs, while the band webs remain engaged with the cams to prevent the band from turning. In order that the invention may be more clearly understood reference is now directed to the accompanying drawings given by way of example in which:

Figure 1:
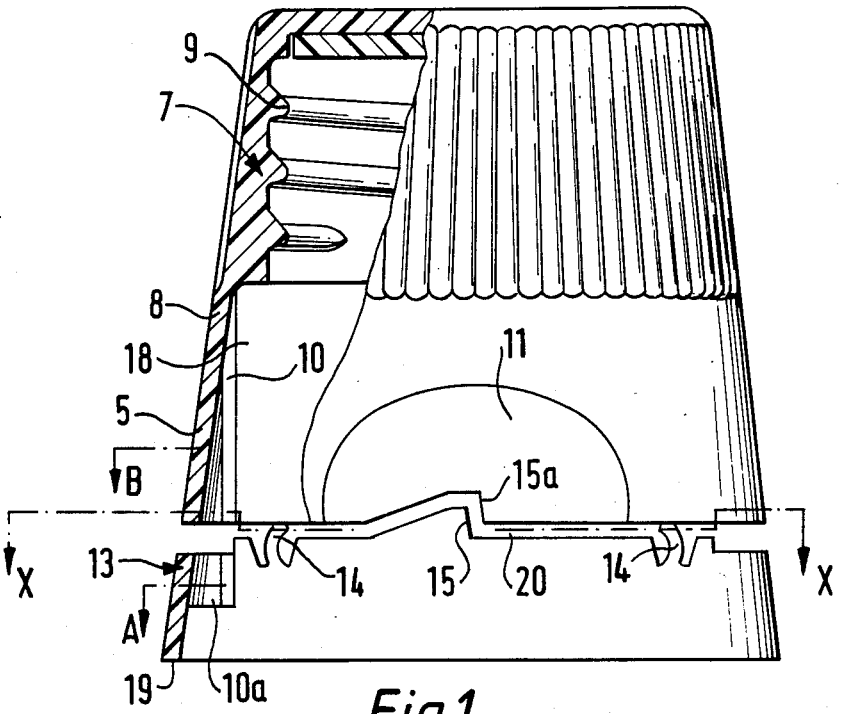
FIG. 1 is a partly sectional side view of a closure embodying the invention.
Figure 3:
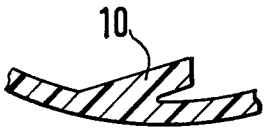
FIG. 3 is a scrap section on the line B.
Figure 4:
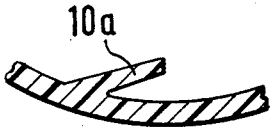
FIG. 4 is a scrap section on the line A.
Figure 2:
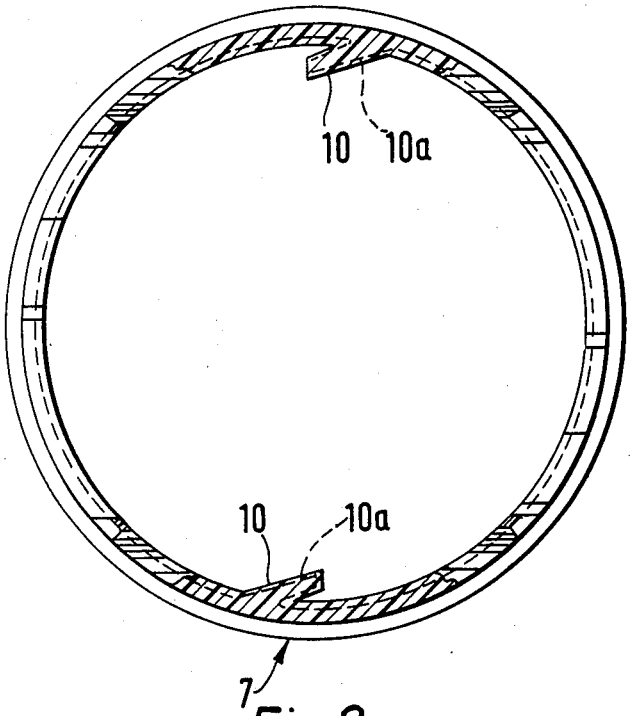
FIG. 2 is a sectional plan view on the line X—X.
Figure 5:
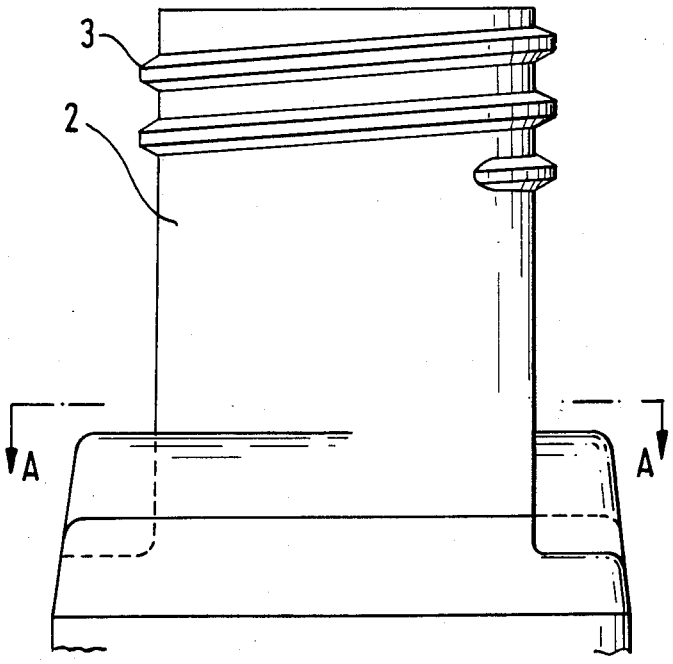
FIG. 5 is a side view of a container neck for use with the closure shown in FIGS. 1 to 4.
Figure 6:
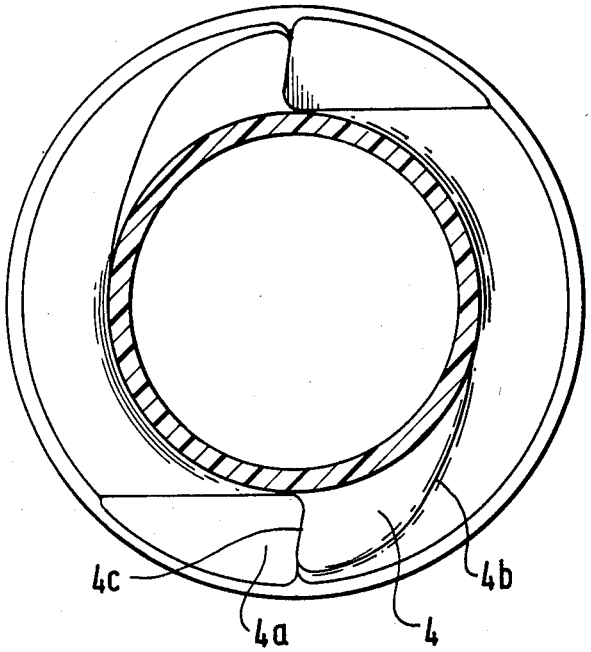
FIG. 6 is a sectional plan view on the line A—A.
Figure 7:
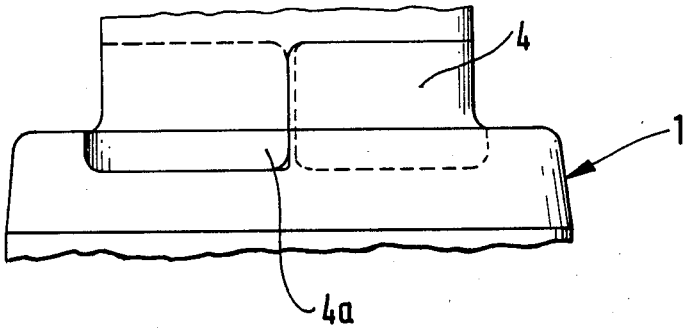
FIG. 7 is a detail elevation.
Figure 8:
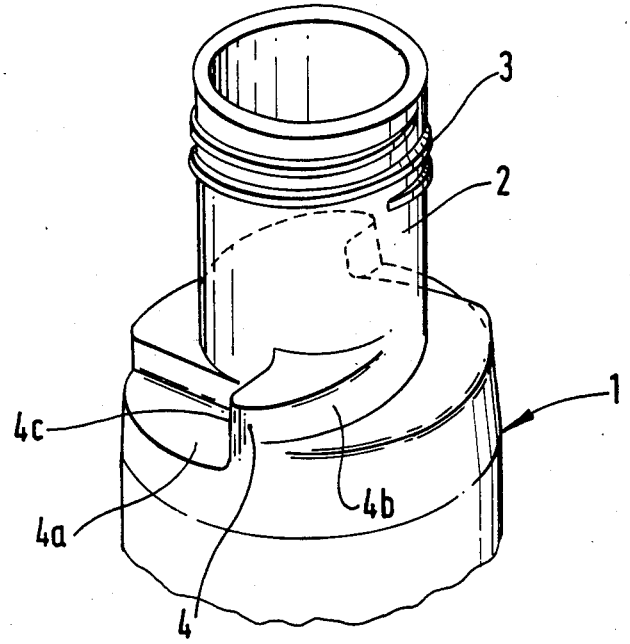
FIG. 8 is a perspective view of the container neck.

Referring first to FIGS. 5 to 8 the container body and closure assembly illustrated comprises a container body 1 with a substantially cylindrical neck 2 with a screw thread 3 near to the top and with cams 4 and recesses 4*a* at the bottom. In plan the cams 4 have an inclined surface 4*b* at one side and a sharp surface or shoulder 4*c* at the other side so that the cams 4 can act like ratchet teeth.

A closure 7, see FIGS. 1 to 4 has an inclined side surface or skirt 8 and a screw threaded part 9 near to the inner top part for engagement with the screw thread 3 on the container neck 2. The inner surface of the cap 7 then tapers outwardly at 5 with inwardly projecting webs 10 for engagement with the cams 4. The outer surface of the closure 7 has two squeeze positions 11 diametrically opposite to one another. In the preferred arrangement, as illustrated, there are two diametrically opposed cams 4, two diametrically opposed webs 10 and two diametrically opposed positions 11 and the squeeze positions 11 are sufficiently displaced from the webs 10, preferably by 90° to ensure that when pressure is applied to the positions 11 the webs 10 are disengaged from the cams 4. The above is generally in accordance with our U.K. Pat. No. 1524395. The closure 7 also has a tamper-resistant band 13 at the bottom connected to the main part of the closure 7 by frangible tongues 14. The top edge of the band 13 also has driven teeth or dogs 15 and the inner surface of the band 13 has an internal annular projection for engagement below an external projection near to the bottom of the neck of the container. The fact that the inner surface of the closure tapers outwardly at 5 while the corresponding outer surfaces of the container neck is substantially vertical means that gaps 18 appear between the closure and the container.

In operation when the closure is first applied to the container neck and is screwed into position the webs 10 on the inside of the closure 7 ride up along the inclined surfaces 4*b* of the cams 4 on the container neck and then seat beyond the shoulders 4*c* so that the cams 4 and the webs 10 serve, in each case, as a ratchet and pawl to prevent unscrewing of the closure. While this movement is taking place the main part of the closure 7 tends to move downwardly towards the band 13 so that a gap 20 between the bottom of the skirt of the closure and the top of the band tends to close to increase the area of overlap between driving dogs 15*a* on the bottom of the skirt and the driven dogs 15 on the top of the band. In addition if the band 13 tends to lag behind the main part of the closure the driving dogs 15*a* catch up the driven dogs 15 and the band is driven round with the main part of the closure. The bow shape of the tongues 14 allows the tongues to deform as they adjust their shape during the movement.

Figure 9:
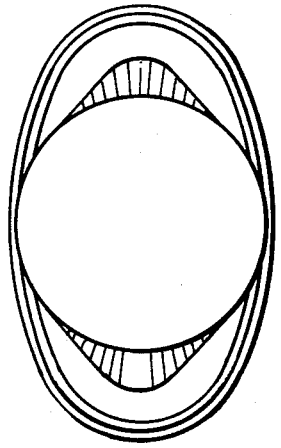
FIG. 9 is a plan of the closure being squeezed, drawn to a reduced scale.

In addition the band 13 is provided with webs 10*a* also for cooperation with the cams 4 on the container neck. As the closure is screwed on to the container neck the webs 10*a* on the inside of the band also ride up along the inclined surfaces 4*b* of the cams 4 on the container neck and then seat beyond the shoulders 4*c*. It will be understood that the webs 10 and 10*a* are flexible and resilient so that they can flex to run up the inclined surfaces 4*b* and then spring back into their normal operative position. The webs 10*a* are thinner and more flexible than the webs 10 to lessen any restraint on the movement of the band during screwing on to prevent premature breakage of the tongues. In order to disengage the closure 7 from the container 1 it is necessary to squeeze the closure 7 at the squeeze positions to deform the closure 7 into an elliptical shape—see FIG. 9, to disengage the closure webs 10 from the cams 4 after which the closure 7 can be unscrewed from the container. The outwardly tapered side walls of the closure provide sufficient space between the closure and the neck of the container to enable the squeeze unlocking to be effective. At the same time unscrewing of the closure 7 causes the main part of the cap to rise, but the band 13 cannot turn due to engagement of the band webs 10*a* with the lower edge of the shoulders 4*c* on the cams 4. This means that the main part of the closure 7 will rise but the band 13 will remain in the same position, the tongues will therefore break and the band 13 will be left behind.

If the closure be in the condition shown in FIG. 1 with the tongues 14 intact and in position on the container then the closure 7 has not been removed from the container since it left the factory. This gives a clear indication that the contents of the container have not been tampered with. On the other hand if the tongues be broken then that indicates that the contents may have been tampered with; this is the tamper-resistant or tamper evident feature. The child resistant feature is provided by the engagement of the webs 10 with the cams 4 which makes it impossible to turn the closure 7 to unscrew it unless the user squeezes the closure at the positions 11. This is both too strong and too complex for a small infant to comprehend. The whole assembly is preferably moulded from a suitable resilient plastics material and the assembly may be used to contain liquids, powders or solids. It is an important feature of the invention that the webs 10*a* are positioned vertically below the webs 10 so that when ejecting each moulded closure from the mould the webs 10*a* follow the webs 10 along the same path. In order to achieve this the "splits" in the mould, which form the dogs 15-15*a*, the frangible tongues 14 and the gap 20 between the bottom of the skirt and the top of the band, will open first during the opening sequence of the mould. It will then be feasible for the "stripper" bush or plate to push face 19 at the bottom edge of the band and eject the entire closure and band in one integral piece off the corepin. The band webs 10*a* will pass through the void in the corepin vacated by the closure webs 10.

What is claimed is:

1. A tamper resistant and child resistant container and closure assembly comprising a container body with a substantially cylindrical neck including an externally screw threaded portion near to the top and below the screw thread a plurality of cams each with an inclined surface terminating in a sharp shoulder, a closure with a body which tapers internally outwardly from an internally screw threaded part near to the top of the closure and which has a corresponding number of depending webs below the screw thread for engagement with the cams on the container neck in the manner of a ratchet and pawl mechanism and a tamper-resistant band provided below the closure body and connected thereto by frangible means, the band being provided with internal webs vertically below the webs on the closure body also for engagement with the cams so that when the closure is unscrewed after disengagement of the body webs from the cams, the band is prevented from turning by the engagement of the band webs with the cams and the frangible means break.

2. An assembly according to claim 1 wherein the frangible means is in the form of frangible tongues.

3. An assembly according to claim 1 wherein the outer surface of the closure has oppositely disposed squeeze positions displaced preferably by 90° from the closure webs.

4. An assembly according to claim 1 wherein the band has a top edge provided with driven teeth for engagement with driving teeth provided on the bottom edge of the closure body.

5. An assembly according to claim 1 wherein the webs on the closure body and on the band are flexible and resilient, the webs on the band being thinner and more flexible than the webs on the body.

6. A tamper resistant and child resistant container and closure assembly comprising a container body with a substantially cylindrical neck including an externally screw threaded portion near to the top and below the screw thread a plurality of vertically elongated cams each with an inclined surface terminating in a sharp shoulder, a closure with a body including a depending skirt which tapers internally outwards from an internal screw thread near to the top of the closure and which has a plurality of depending webs below the screw thread for engagement with the cams on the container neck in the manner of a ratchet and pawl mechanism, there being the same number of closure webs as there are cams on the container neck and a tamper resistant below the skirt of the closure body and separated by an annular gap between the bottom of the skirt and the top of the band, frangible tongues being provided to connect the band to the skirt and spanning the gap therebetween and the band being provided with internal webbs vertically below the webs on the closure body also for engagement with the cams on the closure body which are elongated sufficiently to enable them to engage with the band webs as well as with the closure webs, the arrangement being such that the closure can be unscrewed after disengagement of the body webs from the cams by squeezing the skirt of the closure at positions displaced from the body webs but the band is prevented from turning by the continued engagement of the band webs with the cams so that the frangible tongues break.

7. An assembly according to claim 1 or 6 wherein the inner surface of the band has an annular projection for engagement below an external projection near to the bottom of the neck of the container.

* * * * *